United States Patent [19]

Smith, Jr.

[11] 4,355,699

[45] Oct. 26, 1982

[54] EMERGENCY RESCUE SYSTEM

[76] Inventor: Charles P. Smith, Jr., 336 N. Palm Dr., Beverly Hills, Calif. 90210

[21] Appl. No.: 209,708

[22] Filed: Nov. 24, 1980

[51] Int. Cl.[3] ..... A62B 1/02

[52] U.S. Cl. ..... 182/12; 182/36; 182/142; 187/6

[58] Field of Search ..... 182/36, 37, 142, 143, 182/144, 145, 12, 13, 14; 187/6

[56] References Cited

U.S. PATENT DOCUMENTS

| | | | |
|---|---|---|---|
| 284,180 | 9/1883 | Burghardt | 182/47 |
| 476,885 | 6/1892 | Loyd | 182/37 |
| 481,888 | 8/1892 | Bergeron et al. | 182/47 |
| 489,368 | 1/1893 | Bruce | 182/142 |
| 688,436 | 12/1901 | Richter | 182/142 |
| 1,027,724 | 5/1912 | Haney | 182/142 |
| 1,086,329 | 2/1914 | Liess | 182/142 |
| 3,145,801 | 8/1964 | Callahan | 182/142 |
| 3,159,110 | 12/1964 | Wylie | 182/36 |
| 3,681,565 | 8/1972 | Fisher | 182/142 |
| 3,687,321 | 8/1972 | Goodhart | 182/63 |
| 3,931,868 | 1/1976 | Smith | 182/63 |
| 3,967,699 | 7/1976 | Jasch | 182/142 |

FOREIGN PATENT DOCUMENTS

| | | | |
|---|---|---|---|
| 218225 | 11/1961 | Austria | 182/36 |
| 862308 | 3/1961 | United Kingdom | 182/36 |

*Primary Examiner*—Reinaldo P. Machado

*Attorney, Agent, or Firm*—Fulwider, Patton, Rieber, Lee & Utecht

[57] ABSTRACT

An emergency rescue system for use in rescuing persons trapped in the upper floors of a multistory building during emergency conditions such as during a fire or the like. The rescue system comprises a rescue gondola suspended alongside the exterior face of the building by a suspension cable. The suspension cable is secured to a carriage at the top of the building including means for adjusting the length of the suspension cable to adjust the elevational position of the gondola, and the carriage is movable along a track at the top of the building to adjust the lateral position of the gondola. A tension cable is removably secured between the carriage and a fixed point near the base of the building, and is received over the exterior face of the gondola to steady the gondola and to urge the gondola inwardly toward the building.

16 Claims, 14 Drawing Figures

EMERGENCY RESCUE SYSTEM

BACKGROUND OF THE INVENTION

This invention relates to emergency rescue systems for use in rescuing trapped persons from multistory buildings and the like. More specifically, this invention relates to an improved emergency rescue system designed for use in quickly and easily rescuing trapped persons from upper floors of modern high rise office and apartment buildings during emergency conditions such as a fire, earthquake, tornado, or the like.

The safe removal of persons from burning buildings or from buildings damaged structurally by earthquakes, tornadoes, and the like has been a problem of major concern for a long period of time. This problem is magnified with modern high rise office and apartment buildings which may house several thousand people at any given time. In the prior art, rescue systems for safely evacuating persons from such buildings during emergency conditions have typically comprised stair-type fire escapes constructed as part of the building. More recently, so-called snorkel trucks have been used for reaching upwardly from the ground to rescue persons trapped in upper floors of a building. However, as the height and occupancy level of buildings increases, the safe evacuation of persons from the building becomes dramatically more difficult, and prior art fire escape and emergency rescue systems become of practical use for removing persons only from a few lower floors of the building.

A variety of cage-type structures have been proposed throughout the prior art in an effort to improve upon the limited applicability of stair-type fire escapes, and to provide a system for removing persons from the upper floors of high rise office and apartment buildings. These cage structures are typically suspended along the exterior face of the building by one or more cables attached to the top of the building and the cables are adjusted in length to vary the elevation of the cage structure. See, for example, U.S. Pat. Nos. 284,180; 481,888; 688,436; 1,027,724; and 1,126,583. However, these prior art cage structures have not been widely used in practice largely because they have not included satisfactory apparatus for steadying the cage structure with respect to the exterior face of the building, or for adjusting the lateral position of the cage structure along the exterior face of the building.

More modern emergency rescue systems have been proposed in the form of cage structures suspended from an aircraft such as a helicopter. See, for example, U.S. Pat. Nos. 3,931,868 and 4,195,694. In these systems, the cage structure is transported by the aircraft to a position alongside the exterior face of the building and then elevationally adjusted in position with respect to, for example, a window of the building through which persons may pass into the cage structure for rescue. However, similar to the prior art cage structures supported from the building itself, these aircraft-supported cage structures have not been widely used largely because of the difficulty in satisfactorily steadying the cage structure with respect to the exterior face of the building. In addition, in some situations, the location and intensity of a fire consuming the building may be such that use of a helicopter in the vicinity of the fire is unsafe.

The present invention overcomes the problems and disadvantages of the prior art by providing an improved emergency rescue system including a mobile gondola supported from the top of a multistory building, together with means for closely controlling and steadying the elevational and lateral positions of the gondola alongside the exterior face of the building.

SUMMARY OF THE INVENTION

In accordance with the invention, an emergency rescue system is provided comprising a rescue gondola supported from the top of a multistory building by one or more suspension cables. The suspension cables are carried by a movable carriage mounted on a laterally extending track at the top of the building, and the carriage includes drive means for controllably adjusting the lateral position of the carriage along the track to correspondingly adjust the lateral position of the gondola with respect to the exterior face of the building. The carriage further includes apparatus for adjusting the length of the suspension cables to adjust the elevational position of the gondola. A tension cable is removably secured between the carriage and a fixed point near the base of the building, and this tension cable is engageable with the gondola for steadying the gondola with respect to the building and for urging and maintaining the gondola inwardly toward engagement with the exterior face of the building.

In the preferred embodiment, the carriage includes a carriage base mounted for movement along the fixed track, and one or more davits extending upwardly from the carriage base. The davits are movable between an operative position overhanging the exterior face of the building for supporting the gondola by means of the suspension cables along the exterior face of the building, and a generally opposite and inoperative position for swinging the gondola to a stationary position supported by the roof of the building when the gondola is not in use.

The fixed track on the top of the building extends, in one embodiment, linearly along each of the four straight sides of the building wherein a carriage and gondola combination are required on each side of the building. Alternately, in another embodiment, the track includes arcuately curving sections interconnecting the linearly extending sections along straight sides of the building to allow a single carriage and gondola combination to be moved from one side of the building to another. In this latter embodiment, the drive means for laterally adjusting the position of carriage preferably includes a cog wheel drive assembly engageable with the track to drive the carriage linearly along the appropriate linear track section and then arcuately through the arcuately curved section to the next linear section on another side of the building.

The gondola is conveniently provided with apparatus for releasable engaging the exterior face of the building for improving the stability of the gondola with respect to the building. The gondola further includes adjustable roller means for allowing the gondola to roll laterally with respect to the exterior face of the building, and additional roller means for allowing the gondola to roll vertically with respect to the exterior face of the building. Moreover, the gondola includes shock absorber means for reducing vertical shock to the gondola when the gondola is lowered to the ground.

Other features and advantages of the present invention will become apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
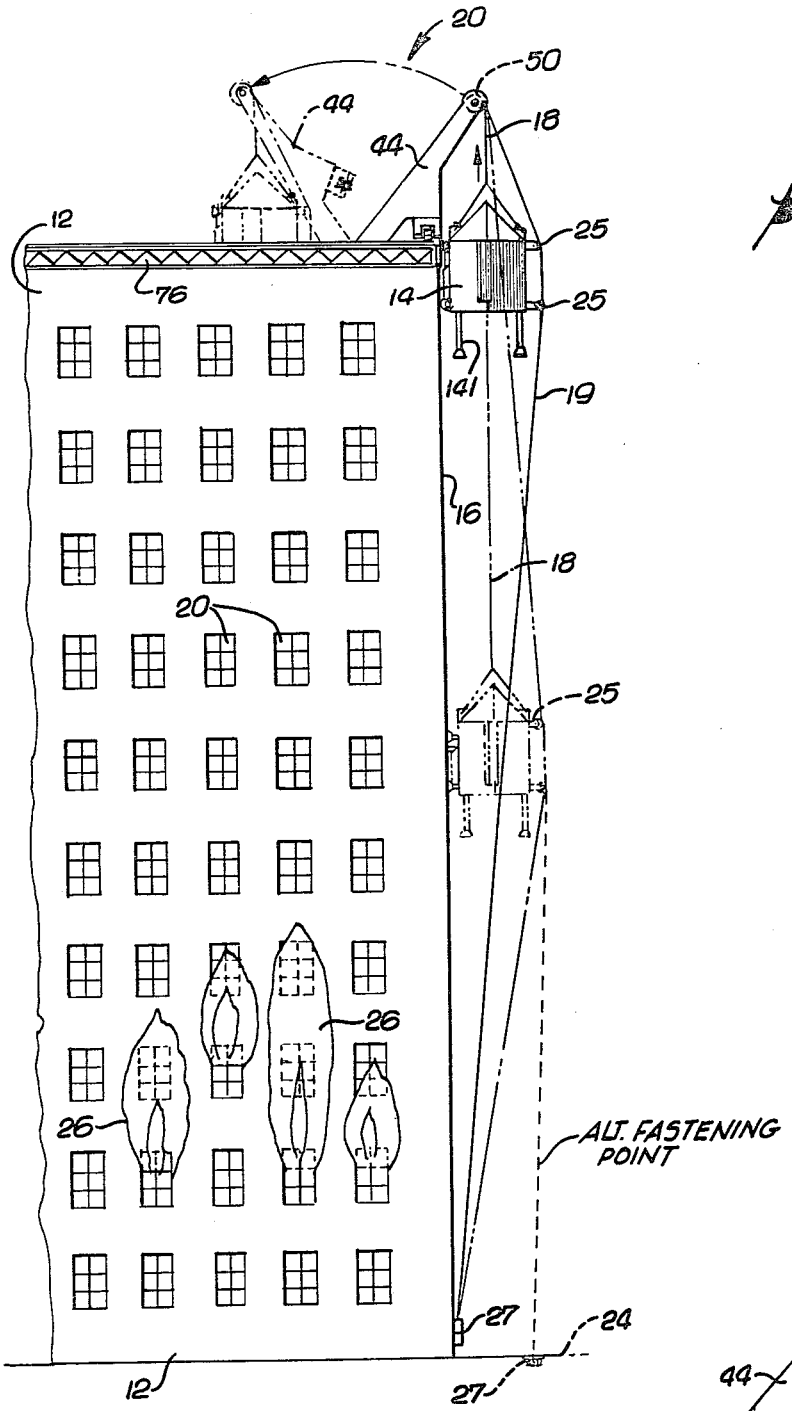
FIG. 1 is an elevation view illustrating operation of the emergency rescue system of this invention.

As illustrated in the exemplary drawings, an emergency rescue system 10 is shown for use in rescuing persons from the upper floors of a multistory building 12. More specifically, as illustrated in FIG. 1, the emergency rescue system 10 of this invention includes an emergency rescue gondola 14 suspended alongside an exterior face 16 of the building 12 by one or more suspension cables 18 secured to a movable carriage 20 at the top of the building. The movable carriage 20 is movable laterally along the top of the building to adjust the lateral position of the gondola 14 with respect to the building exterior face 16, and the carriage 20 includes means for adjusting the length of the suspension cables 18 to elevationally adjust the position of the gondola. In this manner, the gondola 14, can be aligned with a selected window 22 or the like in the building to receive and rescue persons trapped in the building, whereupon the gondola can be operated to lower those persons safely to the ground 24.

The emergency rescue system of this invention is particularly designed for use with multistory office and/or apartment buildings which may contain a large number of human occupants. The system 10 is designed for use in lieu of conventional interior stair-type fire escapes and the like for rapid rescue and removal of trapped individuals from the building 12. Emergency situations wherein these individuals must be rescued from the building comprise, for example, when the building is being consumed by fire 26, or alternately, when the building has been damaged structurally by an earthquake, tornado, or the like.

The emergency rescue system of this invention offers significant advantages over conventional fire escapes and other rescue systems in the prior art in that the gondola 14 is accurately controllable and adjustable both elevationally and laterally with respect to the exterior face 16 of the building. The gondola 14 can thus be moved to any desired position in alignment with a selected window 22 or the like in the building for rescuing trapped individuals from an upper floor of the building 12. Throughout these elevational and lateral movements, accurate positional control of the gondola 14 is maintained, and further means are provided for urging the gondola inwardly into bearing engagement at all times with the exterior face 16 of the building 12.

As shown in FIGS. 1–4, the gondola 14 comprises a housing-like structure including a floor 28, upstanding side walls 30, and a peaked roof 32. These components are structurally reinforced by appropriate cross-bracing 34 to provide a sturdy and relatively lightweight structure which is suspended from the top of the building 12 by a pair of the suspension cables 18. More specifically, as shown best in FIGS. 2 and 3, the two suspension cables 18 are secured respectively to cable yokes 36 near opposite ends of the gondola, and these cable yokes 36 are in turn connected to anchors 38 which can be conveniently secured to the cross-bracing 34 of the housing structure.

The two suspension cables 18 extend upwardly from the gondola 14 for connection to the movable carriage 20 on the roof 42 of the building 12. This movable carriage 20 comprises a pair of laterally spaced pivoting davits 44 extending upwardly from a carriage base 46 mounted for controlled lateral movement with respect to a track 48 secured to the building roof 42. Importantly, as illustrated in solid lines in FIG. 1, the davits 44 are pivotally movable with respect to the carriage base 46 between an operative position angularly overhanging the exterior face 16 of the building, and an inoperative position as illustrated in dotted lines in FIG. 1 pivoted angularly away from the exterior face 16 of the building, as will be described herein in more detail.

Figure 4:
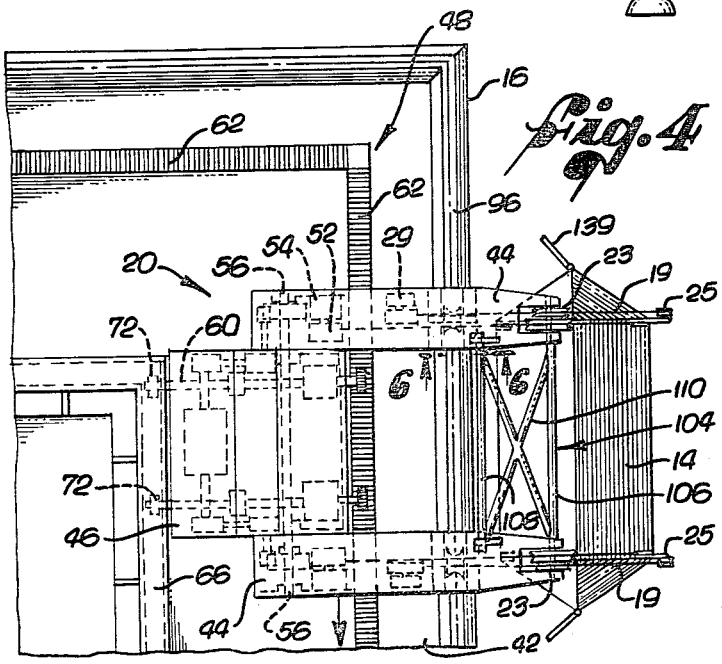
FIG. 4 is a fragmented top plan view illustrating the arrangement for mounting the system upon the top of a building.

The two suspension cables 18 are received respectively over rotatable pulleys 50 at the upper ends of the davits 44, and extend from the pulleys 50 downwardly for winding reception about cable drums 52 mounted on the carriage base 46, as illustrated schematically in FIG. 4. The two cable drums 52 are rotatable in a known manner in response to operation of drive motors 54 to appropriately wind and unwind the suspension cables 18. In this manner, concurrent operation of the drive motors 54 is effective to elevationally adjust the position of the gondola 14 with respect to the exterior face 16 of the building 12. The suspension cables 18 have lengths sufficient to allow the gondola 14 to be elevationally moved alongside the exterior face 16 of the building between the solid and dotted line positions of FIG. 1, or to virtually any other elevational position including a position at rest upon the ground 24.

A pair of tension cables 19 are also wound about respective cable drums 21 on the carriage base 46, and these tension cables 19 are receivable over additional pulleys 23 carried by davits 44. As shown best in FIGS. 1 and 4, these tension cables extend downwardly from the davits over guide pulleys 25 on the exterior face of the gondola 14 for connection to a suitable point 27 near the base of the building 12. Alternately, if desired, these tension cables 19 can be secured directly to the ground 24. In use, tension cables 19 have their lengths adjusted by rotation of the cable drums 21 by individual motors 29 to engage the guide pulleys 25 of the gondola 14 to urge the gondola inwardly toward bearing engagement with the exterior face 16 of the building. In this manner, the tension cables 19 serve to steady and stabilize the gondola with respect to the building for easy passage of persons through a window 22 into the gondola for rescue, as will be described.

The lower ends of the davits 44 are coupled to the carriage base 46 by means of a pair of relatively short pivot bars 56 which accommodate the pivoting movement of the davits as described above. The carriage base 46 is in turn supported upon a pair of rotatable parallel shafts 60 which include means for engaging the track 48. Drive motors 58, illustrated schematically in FIG. 4, are mounted on the carriage base 46 for rotatably driving the shafts 60 for controlled movement along the track 48. While one drive motor 58 is shown for each one of the shafts 60, a single drive motor can be coupled appropriately to drive both of the shafts 60, if desired.

Figure 2:
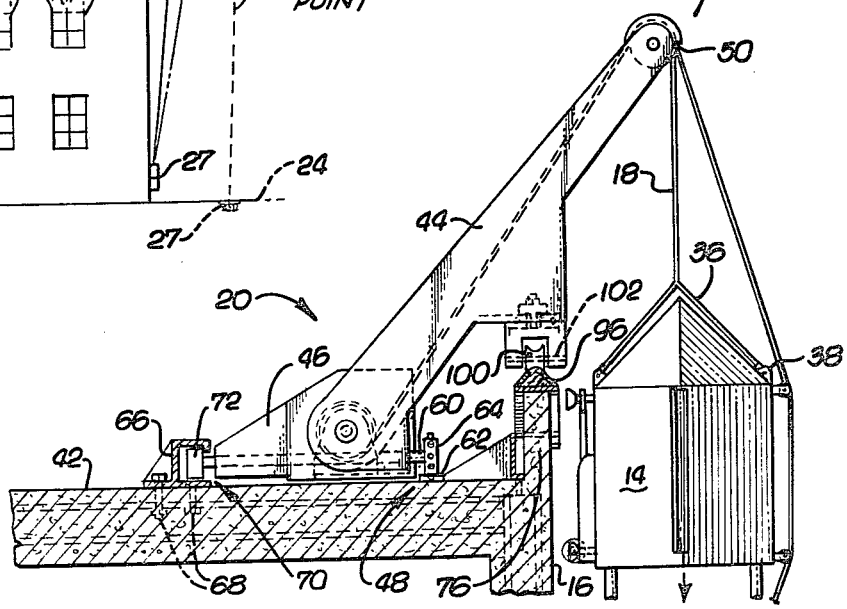
FIG. 2 is an enlarged fragmented elevation view illustrating a portion of the system of this invention.

More specifically, the track 48 comprises a linear rack 62 having a gear tooth profile, as illustrated in FIGS. 2 and 4, mounted on the roof 42 of the building 12 and extending generally in parallel with the exterior face 16 of the building. This rack 62 is positioned for engagement with drive wheels 64 mounted on the adjacent ends of the shafts 60, and these drive wheels 64 include appropriate sized gear teeth for meshing engagement with the rack 62. Accordingly, concurrent operation of the drive motors 58 rotatably drives the shafts 60 in a manner to translate the entire carriage 20 along the rack 62 in a lateral direction. Such lateral movement of the carriage 20 correspondingly translates the gondola 14 in a lateral direction with respect to the exterior face 16 of the building 12.

Figure 5:
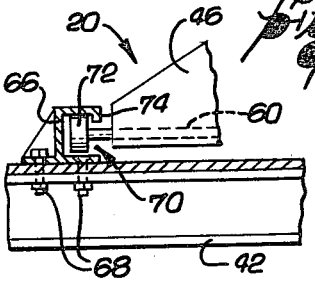
FIG. 5 is an enlarged fragmented vertical section taken on the line 5—5 of FIG. 4.

The shafts 60 extend from the rack 62 rearwardly in a direction perpendicular to the rack for engagement with a guide member 66 forming part of the track 48. This guide member 66 is securely fastened to the roof 42 of the building by appropriate bolts 68 or the like, and defines a forwardly open channel 70 extending in parallel with the rack 62. This channel 70 is sized and shaped for reception of cylindrical rollers 72 on the adjacent ends of the shaft 60. As shown best in FIGS. 5, a lip 74 on the guide member 66 prevents removal of the rollers 72 of the channel 70, whereby the rollers are constrained for movement back and forth along the channel. The drive wheels 64 on the opposite ends of the shaft 60 are thus also constrained for movement along a fixed linear path in parallel with the channel 70, namely, in meshing engagement with the rack 62.

When the davits 44 are pivoted to the operative position overhanging the exterior face 16 of the building 12, as shown in FIG. 2, the guide member 66 also serves to anchor the movable carriage 20 at the top of the building 12. More specifically, with the davits 44 in the operative position, the weight of the suspended gondola 14 tends to lift the entire movable carriage 20 with a moment acting about the line of engagement between the drive wheels 64 and the rack 62. However, the upper extent of the channel 70 is closed by the shape of the guide member 66, whereby the guide member 66 retains the rollers 72 in place within the channel 70. This retention of the rollers 72 within the channel 70 maintains the entire carriage 20 in the desired position on top of the building for controlled movement along the track 48.

Figure 9:
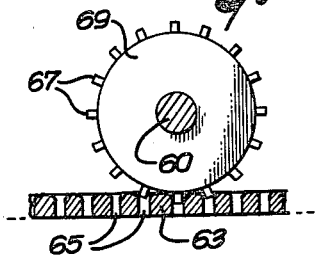
FIG. 9 is an enlarged fragmented portion of FIG. 2 illustrating an alternate drive assembly for the system for use in the embodiment of FIG. 8.
Figure 8:
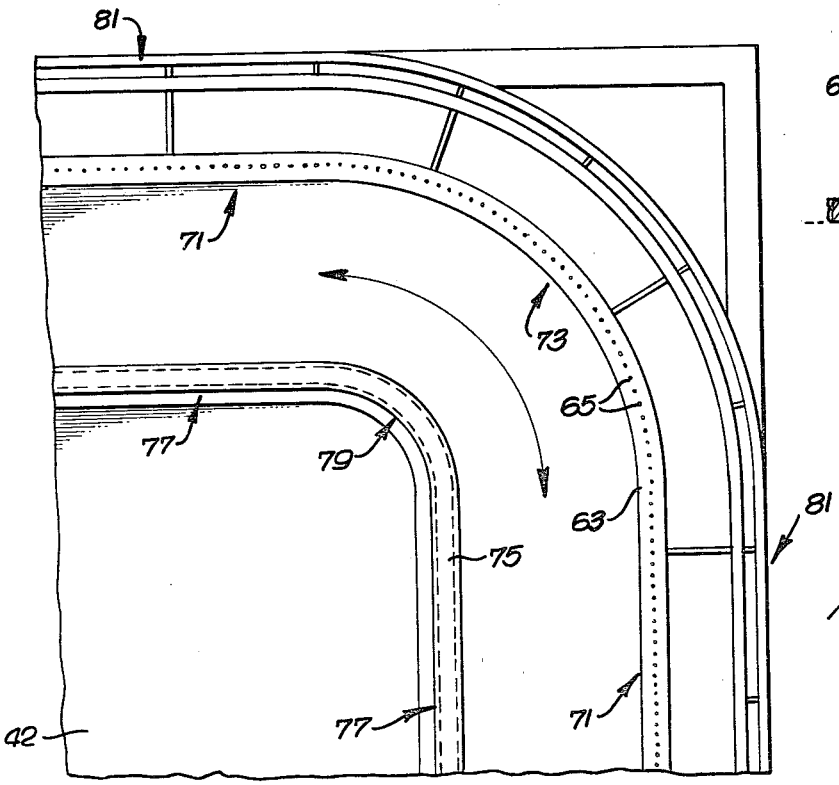
FIG. 8 is a fragmented top plan view illustrating a portion of an alternate embodiment of the inventions.
Figure 10:
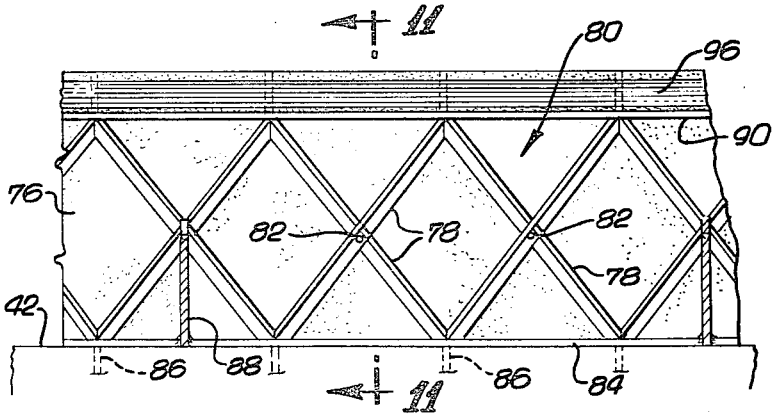
FIG. 10 is an enlarged fragmented vertical section illustrating a portion of the system mounted upon the parapet of a building.

As illustrated in FIGS. 2 and 4, the rack 62 and the guide member 66 forming the track 48 extend in parallel along one straight side of the building 12, and intersect at a right angle with an associated rack 62 and guide member 66 of an adjacent straight side of the building. Since the movable carriage 20 including the drive wheels 64 is capable of linear movement only, an additional carriage 20 and an associated gondola 14 are required for rescuing individuals from the adjacent side of the building. However, if desired, the track 48 can be modified as shown in FIGS. 8 and 9 to include a rack 63 formed to have a plurality of spaced holes 65 for reception of teeth 67 of cog wheels 69 mounted on the shafts 60 of the carriage 20. With this embodiment, the rack 63 can be formed to include straight sections 71 along straight sides of the building, and an arcuately curving section 73 interconnecting those straight sections with the cog wheels 69 effectively turning the corner from one straight side of the building to another. In addition, a modified guide member 75 is provided for receiving the rollers 72 on the carriage shafts 60, and this guide member 75 also includes straight sections 77 joined together at a corner of the building by an arcuately curving section 79. With this arrangement, the movable carriage 20 can be driven laterally to move the suspended gondola 14 from one exterior face 16 of the building to an adjacent exterior face.

As shown in FIGS. 2 and 10–12, a parapet 76 for the building 12 is desirably reinforced to help support the davits 44 in their overhanging operative position. This parapet 76, which is typically provided with modern high rise offices and apartment buildings, comprises a relatively short wall upstanding from the periphery of the roof 42 of the building. The parapet 76 is reinforced by a plurality of criss-crossing and angularly oriented brace bars 78 of steel or the like extending the full height of the inside face 80 of the parapet 76 and secured to the parapet at their points of intersection by bolts 82. These brace bars 78 have their lower ends secured in an appropriate manner as by welding to a sole plate 84 which is suitably anchored to the building roof 42 by another plurality of bolts 86. If desired, periodic angle braces 88 can be connected to the brace bars 78 and the sole plate 84 to extend inwardly from the parapet 76 and thereby provide additional structural support therefor.

The upper ends of the brace bars 78 are joined to a cap plate 90 in a suitable manner such as by welding, and this cap plate encloses the upper surface of the parapet 76. The cap plate 90 is in turn secured as by welding to a second plurality of brace bars 92 which extend downwardly alongside the exterior face 94 of the parapet 76. These latter brace bars 92 are shorter that the interior brace bars 78, and extend from the cap plate 90 angularly downwardly for intersection and connection of the lower ends to the parapet 76 by the bolts 82.

Figure 11:
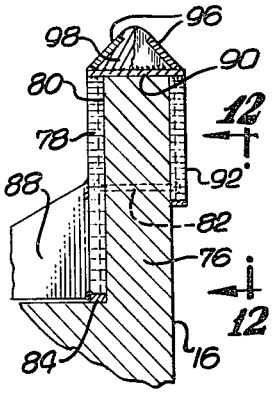
FIG. 11 is a fragmented vertical section taken generally on the line 11—11 of FIG. 10.
Figure 12:
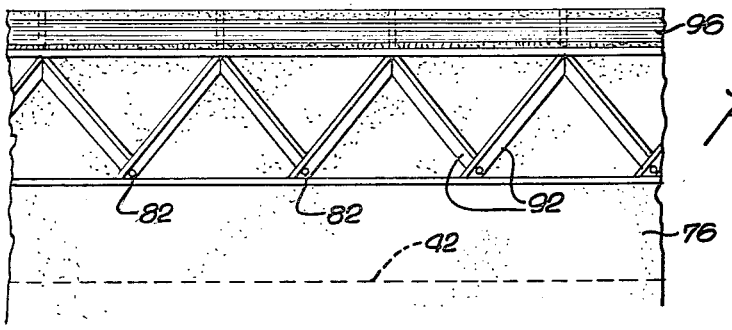
FIG. 12 is a fragmented vertical section taken generally on the line 12—12 of FIG. 11.

The cap plate 90 supports a pair of track rails 96 which are appropriately connected to the cap plate and define angularly disposed bearing surfaces extending longitudinally in parallel with the track 48 on the roof 42. As shown in FIG. 11, these track rails 96 define a downwardly opening V-shaped cross section, with a suitable filler material 98 such as concrete being disposed between the track rails.

Each davit 44 carries a bearing pulley 100 depending downwardly from a position generally intermediate the length of the davit and rotatable about an axle 102 for engagement with the track rails 96 when the davit 44 is in the operative position, as shown in FIG. 2. In this manner, the bearing pulley 100 of each davit rollingly engages the track rails 96 on top of the parapet 76 whereby the reinforced parapet 76 provides vertical support for the davit 44 intermediate the length of the davit. Of course, the bearing pulleys 100 of the two davits 44 roll along the track rails 96 as the lateral position of the movable carriage 20 is adjusted along the track 48, as described above.

Figure 6:
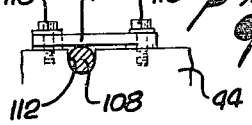
FIG. 6 is an enlarged fragmented vertical section taken on the line 6—6 of FIG. 4.

As shown in FIG. 4, the parapet 76 extends along each straight side of the building and intersects at a right angle with the parapet 76 of an adjacent straight side of the building. However, when the alternate carriage drive means in the form of the cog wheels 69 are used as shown in FIGS. 8 and 9, the parapet construction is modified to include straight sections 81 along straight sides of the building which are joined together by an arcuately curving section 83. With this construction, the bearing pulleys 100 of the davits 44 roll continuously through the arcuately curving section 83 from one straight section 81 to another, whereby a single gondola 14 can be used to rescue persons from more than one side of the building. The two davits 44 are further reinforced with respect to each other by a cross frame 104 connected between the davits, as illustrated in FIG. 4. As illustrated, this cross frame 104 comprises upper and lower horizontal struts 106 and 108 interconnected by angularly intersecting cross-struts 110, with the upper and lower struts 106 and 108 being removably secured to the davits 44 to rigidify the davits as the gondola 14 is raised and lowered. In a preferred embodiment, the upper strut 106 is pivotally received in aligned holes (not shown) in the two davits 44, and the lower strut 108 is secured within recesses 112 in the davits 44 by clamp plates 114 fixed in position by bolts 116, as shown in FIG. 6. Alternately, if desired, the upper strut 106 can also be secured in position by clamps 114.

As shown in FIG. 2, the gondola 14 has an overall length slightly greater than the lateral distance between the davits 44 when the gondola is suspended in the operative position alongside the exterior face 16 of the building. When it is desired to move the gondola 14 to the inoperative position as shown by the dotted lines in FIG. 1, it is necessary to spread the davits 44 laterally with respect to each other to allow passage of the gondola between the davits 44 to the inoperative position at rest upon the roof 42 of the building.

Figure 7:
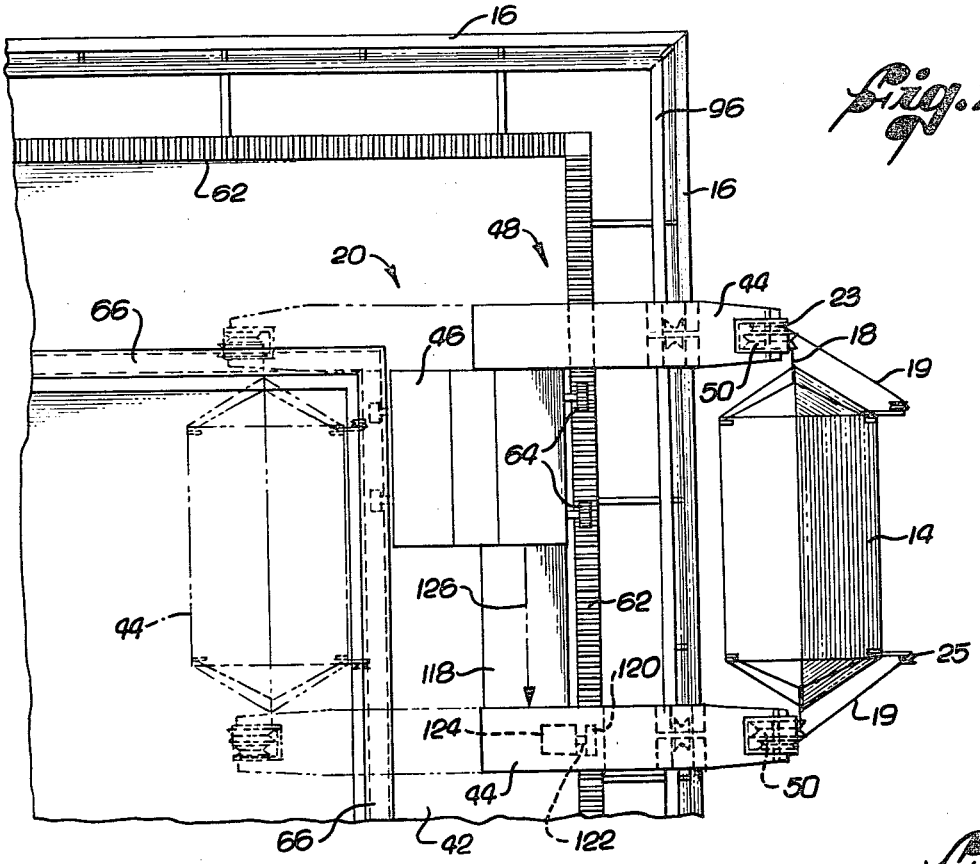
FIG. 7 is an enlarged fragmented top plan view illustrating movement of the system between operative and inoperative positions.

When the gondola 14 is moved to the inoperative position, the cross frame 104 between the davits 44 is removed. At this time, the davits 44 are laterally spread a sufficient distance to allow passage therebetween of the gondola 14, as illustrated in FIG. 7. For this purpose, the base 46 of the movable carriage 20 is secured to one of the two davits 44, and a telescoping base section 118 is slidably received with respect to the base 46. A separate drive wheel 120 is carried on a shaft 122 on the other davit 44, and this separate drive wheel 120 is engageable with the rack 62 and operable by a motor 124 independent of the two drive wheels 64 of the base 46. Accordingly, the separate drive wheel 120 can be driven independently of the drive wheels 64 to slide the telescoping base section outwardly with respect to the base 46, as illustrated by arrow 126, to laterally spread the davits 44.

With the davits 44 spread apart as shown in FIG. 7, the davits 44 can be pivoted rearwardly about their respective pivot bars 56 to move the gondola 14 to the inoperative position at rest upon the roof 42 of the building. When the gondola is returned to the operative position suspended alongside the exterior face 16 of the building, the davits 44 are returned to their positions overhanging the building and the separate drive wheel 120 is operated to retract the telescoping base section 118 back to its initial position within the base 46 of the carriage 20, as shown in FIG. 4. The davits 44 can then be moved laterally in either direction by simultaneous operation of the drive wheels 64 and the separate drive wheel 120. Alternately, the telescoping base section 118 can be locked in position with respect to the base 46 by suitable locking means (not shown), and the separate drive wheel 120 can be allowed to free wheel on the rack 62.

The gondola 14 can thus be moved to the operative position suspended alongside the exterior face 16 of the building, whereupon the elevational position of the gondola 14 can be selected by proper adjustment of the lengths of the suspension cables 18. The lateral position of the gondola 14 can also be controlled according to the position of movement of the movable carriage 20 along the track 48. At all times, the tension cables 19 stabilize the gondola with respect to the building, and maintain the gondola in engagement with the building. Conveniently, the upper ends of the tension cables 19 are carried by the laterally movable carriage 20 whereby these tension cables 19 are adjusted sufficiently in lateral position upon movement of the carriage 20 to allow broad range lateral movement of the gondola throughout the upper floors of the building, in spite of the fact that the lower ends of the tension cables 19 are secured to the fixed point 27 at or near the base of the building.

Figure 3:
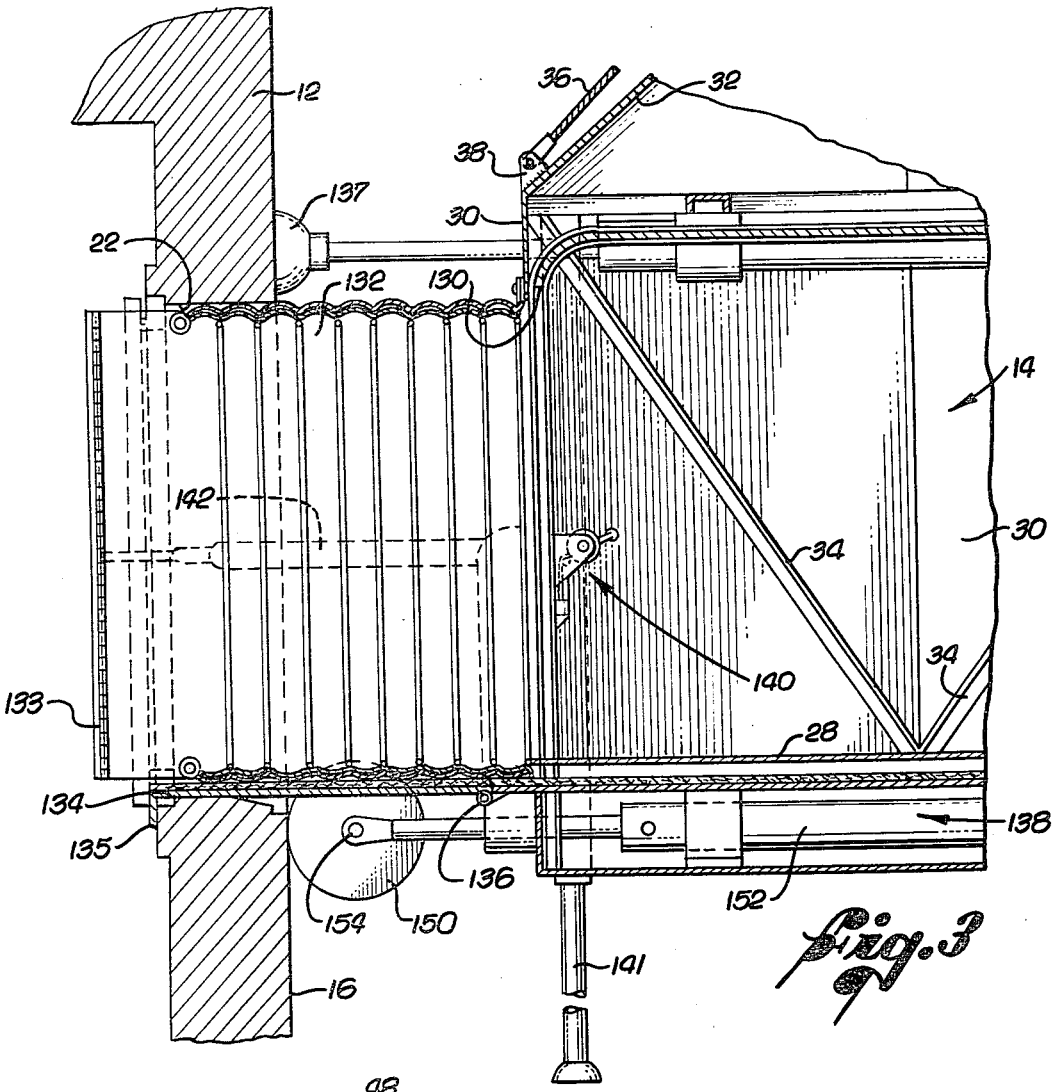
FIG. 3 is an enlarged fragmented vertical elevation view of a portion of the emergency rescue system shown in operating engagement with a window along an exterior face of a building.

As shown in FIG. 3, the gondola 14 includes an entrance opening 130 presented toward the building 12, and a telescoping entryway 132 is provided for projection into the building through a window 22 or the like. A rigid walkway 134 slides outwardly over a roller 136 from storage space 138 underneath the gondola floor 28 to project into and through the window 20. Thus, persons trapped inside the building 12 can enter the gondola 14 by walking through the entryway 132 into the interior of the gondola, whereupon the gondola can lowered to the ground to remove those persons from the building. Conveniently, the walkway 134 is equipped with a downturned lip 135 for secure engagement with the building, and the entryway 132 includes flaps 133 for shielding persons from broken glass in the area of the windows. If desired, hydraulically extensible and retractable suction cups 137 can also be provided for temporary engagement with the building to steady the gondola with respect to the window 22 during the time persons are entering the gondola through the entryway 132. Conveniently, the gondola can also be provided with wind rudders 139 for improved resistance to wind, and shock absorbing legs 141 to absorb shock when the gondola is lowered to the ground.

Appropriate controls 140 operable from within the gondola 14 are provided to appropriately operate an hydraulic ram 142 to project or retract the entryway 132 with respect to the window 22. These controls 140 can also be coupled to the appropriate driving motors on the movable carriage 20 to adjust the elevational and lateral position of the gondola. In this manner, a rescue worker within the gondola has complete control over the position of the gondola and the projection of the entryway 132 through a building window 22 for rescue of people from the building.

Figure 13:
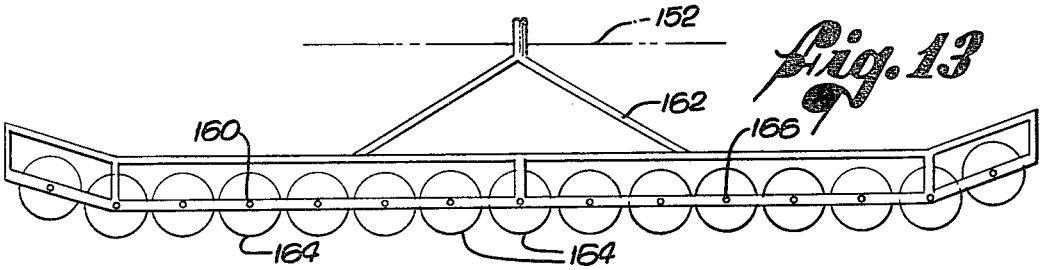
FIG. 13 is an enlarged somewhat schematic illustration of roller apparatus for engaging the exterior wall of a building during operation of the system.
Figure 14:
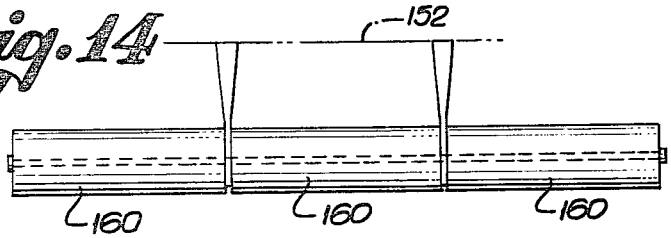
FIG. 14 is an enlarged somewhat schematic illustration of alternate roller apparatus for engaging the exterior wall of a building during operation of the system.

As illustrated in FIG. 3, a wheel 150 is conveniently connected to the distal end of an hydraulic ram 152 carried within the storage space 138 beneath the floor 28 of the gondola 14. This wheel 150 is rotatable about a horizontal axle 154, and is engageable with the exterior face 16 of the building when the ram is extended. The wheel 150 advantageously provides a rolling surface between the building and the gondola to facilitate elevational adjustment of the gondola position. Alternately, if a broader rolling surface is desired, a plurality of rollers 160 can be secured to the distal end of the ram 152, as illustrated in FIG. 14. Still further, as shown in FIG. 13, a carrier 162 can be secured to the distal end of the ram 152 wherein the carrier 162 supports a plurality of small wheels 164 for rotation about vertical pins 166 to facilitate lateral positional adjustment of the gondola with respect to the building. Or, if desired, a pair of the hydraulic rams 152 can be provided respectively carrying the rollers 160 of FIG. 14 and the wheels 164 of FIG. 13, wherein the pair of rams 152 can be alternately extended in response to operation of the controls 140 for rolling engagement of one of these mechanisms with the building.

The emergency rescue system 10 of this invention thus provides a versatile gondola 14 suspended from the top of the building 12 for movement vertically and laterally in a controlled and stable manner with respect to an exterior face 16 of a multistory building. The controlled versatility of movement of the gondola enables the system of this invention to be used quickly, easily and accurately in rescuing a large number of people from the building.

Various modifications and improvements to the emergency rescue system of this invention are believed to be apparent to one skilled in the art. Accordingly, no limitation upon the invention is intended except by way of the appended claims.

I claim:

1. An emergency rescue system for use in rescuing persons from a multistory building, comprising:

a movable carriage mounted at the top of the building for lateral movement with respect to an exterior face of the building, said carriage including a base having first and second sections movable laterally with respect to each other and respectively supporting a pair of davits extending upwardly generally in parallel for pivoting movement between an operative position overhanging the exterior face of the building and an inoperative position pivoted away from the exterior face of the building, each of said davits including a pulley mounted near its upper end;

a gondola for suspension alongside the exterior face of the building;

a pair of suspension cables extending respectively between said first and second sections of said movable carriage over said pulleys on said davits and connected to said gondola whereby said gondola is suspended from said carriage;

means on said carriage for adjusting the length of said suspension cables for adjusting the elevational position of said gondola;

means for urging said gondola into bearing engagement with the exterior face of the building; and means for laterally moving said carriage to adjust the lateral position of said gondola;

said carriage further including means for driving said first and second sections of said carriage base relatively away from each other to spread said davits and facilitate swinging movement of said davits between said operative position with said gondola overhanging the exterior face of the building and said inoperative position with said gondola on top of the building, and for driving said first and second sections back toward each other.

2. The system of claim 1 including a track at the top of the building extending in a direction generally parallel with the exterior face of the building, said movable carriage being mounted for controlled movement along said track.

3. The system of claim 2 wherein said track includes means for constraining said movable carriage in a position in engagement with said track.

4. The system of claim 1 wherein each of said suspension cables is wound about a respective cable drum mounted on said carriage base, and wherein said means for adjusting the length of said suspension cables comprises a motor for rotatably driving said respective cable drum.

5. The system of claim 2 wherein said means for laterally moving said carriage comprises drive means mounted on said carriage base in driving engagement with said track.

6. The system of claim 1 wherein said means for urging said cable into bearing engagement with the exterior face of the building comprises a tension cable connected between said carriage and a point near the base of the building, means for retaining said tension cable in bearing engagement with the side of said gondola opposite the building, and means on said carriage for adjusting the length of said tension cable to urge said gondola in bearing engagement with the building.

7. The system of claim 1 wherein said gondola defines an enclosed space for receiving a plurality of persons, and includes a telescoping entryway for projection toward the building for passage of persons from the building into the gondola.

8. The system of claim 1 wherein said gondola includes wheel means for rolling engagement in a vertical direction with respect to the building.

9. The system of claim 1 wherein said gondola includes wheel means for rolling engagement in a horizontal direction with respect to the building.

10. An emergency rescue system for use in rescuing persons from a multistory building, comprising:

a track mounted at the top of the building;

a movable carriage including a carriage base mounted for movement along said track in a lateral direction with respect to an exterior face of the building, and a pair of laterally spaced davits extending generally in parallel from said carriage base and pivotally connected to said carriage base for pivoting movement between an operative position extending angularly upwardly and outwardly to positions overhanging the exterior face of the building and an inoperative position pivoted away from the exterior face of the building, each of said davits including a pulley mounted near its upper end;

a gondola for suspension alongside the exterior face of the building;

a pair of suspension cables coupled to said carriage base and respectively received over said pulleys and secured to said gondola whereby said gondola is suspended from said movable carriage for movement between a position overhanging the exterior face of the building when said davits are in said operative position and a position on top of the building when said davits are in said inoperative position;

means on said carriage base for adjusting the lengths of said suspension cables to adjust the elevational position of said gondola;

a tension cable connected between said carriage base and a point near the base of the building, said tension cable being engageable with the side of said gondola opposite the building for urging said gondola into bearing engagement with the exterior face of the building; and means for driving said carriage base along said track to adjust the lateral position of said gondola;

said carriage base further comprising first and second sections movable laterally with respect to each other and respectively supporting said pair of davits and including means for driving said first and second sections along said track relatively away from each other to spread said davits and facilitate swinging movement of said gondola during movement of said davits between said operative and inoperative positions and for driving said first and second sections along said track relatively toward each other to correspondingly move said davits back toward each other.

11. The system of claim 10 including means on said carriage base for adjusting the length of said tension cable to bring said tension cable into bearing engagement with said gondola.

12. The system of claim 10 including at least one guide pulley positioned on the side of said gondola opposite the building for receiving said tension cable.

13. The system of claim 10 wherein the building includes a parapet, said davits overhanging said parapet when in said operative position, and including roller means depending from said davits for rollingly engaging said parapet generally intermediate the lengths of said davits when said davits are in said operative position.

14. The system of claim 13 including means for structurally reinforcing said parapet.

15. The system of claim 10 wherein said track comprises a linear gear tooth rack mounted on the top of the building, said carriage drive means comprises a shaft rotatably carried by said carriage base, a drive wheel mounted on said shaft and including gear teeth in meshing engagement with said rack, and motor means for rotatably driving said shaft.

16. The system of claim 10 wherein the track comprises a first linear section on the top of the building extending generally in parallel with the exterior face of the building, a second linear section on the top of the building extending generally in parallel with another exterior face of the building, and an arcuately curving section interconnecting said first and second linear sections, and wherein said carriage drive means includes means for driving said carriage base along said first linear section and through said arcuately curving section to said second linear section along said another exterior face of the building whereby said gondola is moved to said another exterior face of the building.

* * * * *